US009377013B2

(12) United States Patent
Bonnefoi et al.

(10) Patent No.: US 9,377,013 B2
(45) Date of Patent: Jun. 28, 2016

(54) OIL INJECTION DEVICE FOR VARIABLE-SPEED SCROLL REFRIGERATION COMPRESSOR

(71) Applicant: DANFOSS COMMERCIAL COMPRESSORS, Trevoux (FR)

(72) Inventors: Patrice Bonnefoi, Saint Didier Au Mont d'Or (FR); Dong Wang, Tianjin (CN); Pierre Ginies, Sathonay Village (FR); Ingrid Claudin, Meximieux (FR)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 413 days.

(21) Appl. No.: 13/715,429

(22) Filed: Dec. 14, 2012

(65) Prior Publication Data

US 2013/0156612 A1 Jun. 20, 2013

(30) Foreign Application Priority Data

Dec. 14, 2011 (FR) ..... 11 61593

(51) Int. Cl.
*F04B 35/04* (2006.01)
*F04C 23/00* (2006.01)
(Continued)

(52) U.S. Cl.
CPC ..... *F04B 35/04* (2013.01); *F04C 18/0215* (2013.01); *F04C 23/008* (2013.01); *F04C 29/021* (2013.01); *F04C 29/025* (2013.01); *F04C 29/026* (2013.01); *F04C 28/08* (2013.01)

(58) Field of Classification Search
CPC ..... F04C 29/02; F04C 29/021; F04C 29/025; F04C 29/026; F04C 28/08; F04C 23/008; F04C 18/0215; F04B 39/023; F04B 39/0261; F04B 35/04
USPC ..... 417/228, 410.3, 410.5
See application file for complete search history.

(56) References Cited

U.S. PATENT DOCUMENTS 6,125,642 A 10/2000 Seener et al.
2003/0063986 A1 * 4/2003 Ginies ..... F04C 23/008 417/366

(Continued)

FOREIGN PATENT DOCUMENTS

FR 2 885 966 A1 11/2006
FR 2 916 813 12/2008
JP A-06-185479 7/1994

OTHER PUBLICATIONS

Darcy-Weisbach Equation.*

(Continued)

*Primary Examiner* — Justin Jonaitis
*Assistant Examiner* — Christopher Brunjes
(74) *Attorney, Agent, or Firm* — Oliff PLC

(57) ABSTRACT

The oil injection device according to the invention includes an oil pump designed to be rotationally coupled to the electric motor of a compressor and including inlet and outlet ports, an oil injection duct connected to the first outlet port and designed to supply a compression stage of the compressor with oil, and an oil return duct connected to the first outlet port and designed to return the oil into an oil sump of the compressor. The pressure losses in the oil injection duct are primarily singular pressure losses proportional to the square of the oil flow rate passing through the oil injection duct. The pressure losses in the oil return duct are primarily pressure losses due to friction proportional to the oil flow rate passing through the oil return duct.

19 Claims, 5 Drawing Sheets

(51) Int. Cl.

| | |
|---|---|
| ***F04C 29/02*** | (2006.01) |
| ***F04C 18/02*** | (2006.01) |
| ***F04C 28/08*** | (2006.01) |

(56) References Cited

U.S. PATENT DOCUMENTS

2006/0118264 A1* 6/2006 Takeya ..... B22D 17/2007 164/72
2010/0098570 A1* 4/2010 Bodart ..... F04C 29/021 418/55.1
2010/0122550 A1* 5/2010 Cho ..... F01C 21/007 62/473

OTHER PUBLICATIONS

Darcy-Weisbach Equation—http://en.wikipedia.org/wiki/Darcy%E2%80%93Weisbach_equation.*

* cited by examiner

OIL INJECTION DEVICE FOR VARIABLE-SPEED SCROLL REFRIGERATION COMPRESSOR

The present invention relates to an oil injection device for a variable-speed scroll refrigeration compressor.

Document FR 2,885,966 describes a scroll compressor comprising a sealed enclosure delimited by a shroud, delimiting a suction volume and a compression volume respectively arranged on either side of a body contained in the enclosure. The shroud delimiting the sealed enclosure comprises a refrigerant inlet.

An electric motor is arranged in the sealed enclosure, with a stator situated on the outer side, mounted stationary relative to the shroud, and a rotor arranged in a central position, secured to a drive shaft in the form of a crankshaft, a first end of which drives an oil pump supplying a lubrication duct formed in the central portion of the shaft from oil contained in a sump situated in the lower portion of the enclosure. The lubrication duct has lubrication ports at the various guide bearings of the drive shaft.

The compression volume contains a compression stage comprising a stationary volute equipped with a scroll engaged in a scroll of a moving volute, the two scrolls delimiting at least one variable-volume compression chamber. The second end of the drive shaft is equipped with an eccentric drive driving the moving volute in an orbital movement, to compress the suctioned refrigerant.

From a practical perspective, refrigerant arrives from the outside and penetrates the sealed enclosure. Part of the refrigerant is suctioned directly toward the compression volume, while the other part of the refrigerant passes through the motor before flowing toward the compression stage. All of the refrigerant arriving either directly at the compression stage or after passing through the motor is suctioned by the compression stage, penetrating at least one compression chamber delimited by the two scrolls, the entry occurring on the periphery of the compression stage, and the refrigerant being conveyed toward the center of the scrolls as the compression occurs by decreasing the volume of the compression chambers, resulting from the movement of the moving volute with respect to the stationary volute. The compressed refrigerant exits at the central portion toward the compressed gas recovery chamber.

Depending on the internal flow configurations of this type of compressor, the refrigerant entering the compressor may become charged with oil, that oil for example coming from leaks in the bearings, from sweeping of the surface of the oil sump by the refrigerant.

It must be noted that the level of oil in the refrigerant evolves as a function of the speed of rotation of the rotor of the electric motor.

Thus, at a low speed of rotation of the rotor, the quantity of oil circulating with the refrigerant is low, which can deteriorate the performance of the compressor and reduces the lubrication of the different parts of the compressor.

However, at a high speed of rotation of the rotor, the level of oil in the refrigerant leaving the compressor may become excessive. The direct consequence of this excessive level of oil in the refrigerant is a loss of efficiency of the heat exchange of the exchangers situated downstream from the compressor, given that the oil droplets contained in the refrigerant tend to be deposited on the exchangers and form a layer of oil on the latter parts.

Furthermore, an excessive level of oil in the refrigerant may also cause emptying of the oil sump, which may significantly damage the compressor.

Document FR 2,916,813 describes a solution to improve the low-speed performance of a variable-speed compressor without harming the efficiency thereof at high speeds. The solution consists of increasing the amount of oil circulated in the refrigerant only for low speeds.

Thus, document FR 2,916,813 discloses an oil injection device for a variable-speed scroll refrigeration compressor, including:

- an oil displacement pump rotated by a drive shaft rotationally coupled to the rotor of an electric motor of the compressor, the oil displacement pump comprising an oil inlet port designed to be connected to an oil sump of the compressor and at least one first oil outlet port,
- two oil injection ducts each connected to the first oil outlet port designed to supply the compression stage of the compressor with oil,
- a solenoid valve fastened on the wall of the sealed enclosure and including a moving core, moving under the effect of a magnetic field between a closed position, allowing oil to be injected into the compression stage via the oil injection conduits and preventing oil from returning toward the oil sump, and an open position, preventing or limiting the injection of oil into the compression stage and allowing oil to return toward the oil sump of the compressor via an oil return port formed in the solenoid valve, and
- control means arranged to move the core of the solenoid valve between the open and closed positions thereof as a function of the speed of the compressor.

Such an oil injection device has the drawback in particular of requiring the presence of a solenoid valve and means for controlling it. This results in a complex, expensive oil injection device that may be unreliable, for example in the event the solenoid valve or its control means break down.

The invention aims to resolve these drawbacks.

The technical problem at the base of the invention therefore consists of providing an oil injection device for a variable-speed scroll refrigeration compressor that has a simple and cost-effective structure, while allowing precise monitoring of the injection of oil into the compression stage of the compressor.

To that end, the present invention relates to an oil injection device for a variable-speed scroll refrigeration compressor, comprising:

- an oil displacement pump designed to be rotationally coupled to the rotor of an electric motor of the compressor, the oil displacement pump comprising an oil inlet port designed to be connected to an oil sump of the compressor and at least one first oil outlet port, and
- at least one oil injection duct connected to the first oil outlet port of the oil displacement pump and designed to supply a compression stage of the compressor with oil,
- wherein the oil injection device also comprises an oil return duct connected to the first oil outlet port of the oil displacement pump and designed to return oil into the oil sump of the compressor, the oil injection duct and the oil return duct being configured such that the pressure losses in the oil injection duct are primarily singular pressure losses proportional to the square of the oil flow rate passing through the oil injection duct, and such that the pressure losses in the oil return duct are primarily pressure losses due to friction proportional to the oil flow rate passing through the oil return duct.

At a low speed of rotation of the compressor, a significant proportion of the oil coming from the first oil outlet port of the oil displacement pump is oriented toward the oil injection duct(s), and is injected into the compression stage. However, as the speed of rotation of the compressor, and therefore of the oil displacement pump, increases, the proportion of the oil coming from the first oil outlet port of the oil displacement pump and supplying the oil injection duct(s) decreases, while the proportion of oil supplying the oil return duct and returned into the oil sump of the compressor increases, due to the fact that the pressure losses in the oil injection duct(s) increase much more quickly with the flow rate passing through the oil injection duct(s) than the pressure losses in the oil return duct. At very high speeds, the majority of the oil coming from the first oil outlet port of the oil displacement pump may potentially be oriented toward the oil return duct and returned to the oil sump.

Consequently, the oil injection device according to the invention provides precise monitoring of the injection of oil in the compression stage of the compressor, without requiring the use of expensive parts, such as a solenoid valve and means for controlling it.

Preferably, the oil displacement pump is configured such that the ratio of the volume flow rate of the oil displacement pump exiting through the first oil outlet port to the speed of rotation of the oil displacement pump is substantially constant irrespective of the speed of rotation of the oil displacement pump. As a result, and due to the configuration of the pressure losses in the oil injection and oil return ducts, the flow rate proportion of the injection device going into the oil injection duct decreases when the speed of rotation of the oil displacement pump increases.

Preferably, the oil displacement pump is designed to be rotated by a drive shaft rotationally coupled to the rotor of the electric motor of the compressor.

Advantageously, the oil injection device has a plurality of oil injection ducts, and for example two oil injection ducts. These arrangements make it possible to ensure a satisfactory oil injection flow rate in the compression stage, including at very low speeds of rotation of the compressor.

Preferably, the oil injection duct comprises a choke member, such as an injection nozzle, mounted at the end of the oil injection duct opposite the oil displacement pump. The singular pressure losses proportional to the square of the oil flow rate passing through the oil injection duct are thus defined by the choke member.

According to one embodiment of the invention, the choke member has an injection port having a diameter smaller than half the diameter of the end portion of the oil injection duct opposite the oil displacement pump. The injection port preferably has a diameter smaller than one quarter, or even one sixth of the diameter of the end portion of the oil injection duct opposite the oil displacement pump, and for example equal to approximately one eighth of the diameter of said end portion.

According to one embodiment of the invention, the injection port has a diameter smaller than at least five times the length of the choke member.

Advantageously, the choke member has a tubular portion having a first open end and a second end at least partially closed by an end wall, the end wall including the injection port.

The oil injection duct and the oil return duct are for example configured such that the pressure losses in the oil injection duct are lower than the pressure losses in the oil return duct when the speed of rotation of the oil displacement pump is lower than a first predetermined value, and such that the pressure losses in the oil injection duct are greater than the pressure losses in the oil return duct when the speed of rotation of the oil displacement pump is above a second predetermined value, the second predetermined value being greater than or identical to the first predetermined value. Thus, as long as the speed of the compressor, and therefore the oil displacement pump, is lower than the first predetermined value, the majority of the oil coming from the first oil outlet port of the oil displacement pump is oriented toward the oil injection duct and is injected into the compression stage, due to the fact that the pressure losses in the oil injection duct are lower than the pressure losses in the oil return duct. On the contrary, when the speed of the compressor, and therefore the oil displacement pump, is above the second predetermined value, the majority of the oil from the first oil outlet port of the oil displacement pump is oriented toward the oil return duct and is returned into the oil sump of the compressor, due to the fact that the pressure losses in the oil injection duct are then greater than the pressure losses in the oil return duct.

According to another embodiment of the invention, the oil injection device includes a closure member, such as a stopper valve, movable between an open position, allowing oil to flow into the oil return duct, and a closed position, preventing oil from flowing in the oil return duct, and return means arranged to bias the closure member toward its closed position.

Preferably, the return means are arranged to keep the closure member in its closed position as long as the speed of rotation of the oil displacement pump is below a predetermined value, and to allow the closure member to move toward its open position once the speed of rotation of the oil displacement pump reaches said predetermined value.

Advantageously, the return means include a spring, the stiffness of which is adjusted so as to allow movement of the closure member toward its open position once the speed of rotation of the oil displacement pump is above the second predetermined value.

Advantageously, the oil return duct has a substantially constant transverse section. The pressure losses by friction proportional to the oil flow rate passing through the oil return duct are thus defined by the inner wall of the oil return duct. In one embodiment of the invention, the oil return duct is formed by a flexible or rigid tubing.

According to one embodiment of the invention, the oil injection duct includes an injection tubing having a substantially constant transverse section. The choke member is advantageously mounted at the end of the injection tubing opposite the oil displacement pump.

According to one embodiment of the invention, the oil injection duct has a length longer than at least 10 times the diameter of the oil injection duct.

According to one embodiment of the invention, the oil return duct has a length greater than at least 10 times the diameter of the oil return duct.

According to one embodiment of the invention, the ratio of the length of the oil injection duct to the diameter of the oil injection duct is greater than the ratio of the length of the oil return duct to the diameter of the oil return duct.

According to one embodiment of the invention, the oil displacement pump is a gear-within-gear positive displacement pump.

According to one feature of the invention, the oil displacement pump comprises a second oil outlet port designed to be connected to a lubrication duct formed in the central portion of a drive shaft rotationally coupled to the electric motor of the compressor.

According to one embodiment of the invention, the oil injection device includes a connector having at least one oil inlet port supplied with oil through a supply duct connected to the first outlet port of the oil displacement pump, a first oil outlet port connected to the oil injection duct, and a second oil outlet port connected to the oil return duct. The connector is advantageously positioned inside the sealed enclosure of the compressor.

The present invention also relates to a variable-speed scroll refrigeration compressor, comprising a sealed enclosure containing a compression stage, an oil sump housed in the lower portion of the sealed enclosure, and an electric motor having a stator and a rotor, wherein the compressor also comprises an oil injection device according to the invention whereof the oil displacement pump is rotationally coupled to the rotor of the electric motor.

According to one embodiment of the invention, the compressor includes a drive shaft rotationally coupled to the rotor of the electric motor and arranged to rotate the oil displacement pump of the oil injection device.

Preferably, the sealed enclosure includes a suction volume and a compression volume respectively arranged on either side of the body contained in the sealed enclosure, the end of the oil injection duct opposite the oil displacement pump emerging in the compression volume.

Advantageously, the end portion of the oil injection duct opposite the oil displacement pump is inserted into a through bore formed in the body separating the compression and suction volumes.

Advantageously, the compression stage comprises a stationary volute and a moving volute each comprising a scroll, the scroll of the moving volute being engaged in the scroll of the stationary volute and being driven in an orbital movement, the moving volute bearing against the body separating the compression and suction volumes.

According to one embodiment of the invention, the compressor includes an intermediate jacket surrounding the stator so as to delimit an annular outer volume with the sealed enclosure on the one hand, and an inner volume containing the electric motor on the other hand, and an oil separating device mounted on the outer wall of the intermediate jacket, the separating device having a refrigerant circulation channel including a refrigerant inlet opening emerging in the annular outer volume and a refrigerant outlet opening emerging in the inner volume. The presence of such a refrigerant circulation channel makes it possible to modify the path of the refrigerant flow in the annular outer volume, and therefore to decrease the speed of the refrigerant before it penetrates the refrigerant circulation channel. Such a decrease in the flow speed of the refrigerant allows some of the oil droplets present in the refrigerant to fall by gravity toward the oil sump. This results in a decrease in the level of oil in the refrigerant, in particular at high speeds of rotation of the compressor, and thus improves the efficiency of the compressor.

Preferably, the refrigerant outlet opening emerges at a window formed in the intermediate jacket so as to put the refrigerant circulation channel in communication with the inner volume delimited by the intermediate jacket.

Advantageously, the refrigerant inlet opening is situated near the end of the electric motor turned toward the compression stage.

Preferably, the sealed enclosure includes a refrigerant inlet emerging in the annular outer volume and axially offset relative to the refrigerant inlet opening of the refrigerant circulation channel.

According to one embodiment of the invention, the circulation channel includes a first portion, turned toward the refrigerant inlet opening, extending substantially parallel to the axis of the compressor, and a second portion, turned toward the refrigerant outlet opening, extending transversely to the axis of the compressor and preferably substantially perpendicular to the axis of the compressor.

According to one embodiment of the invention, the compressor includes a centering piece fastened on the sealed enclosure, the end of the intermediate jacket turned toward the oil sump resting on the centering piece such that the centering piece at least partially closes the end of the intermediate jacket turned toward the oil sump.

The centering piece is advantageously provided with a guide bearing for an end portion of the drive shaft turned toward the oil sump.

In any event, the invention will be well understood using the following description in reference to the appended diagrammatic drawing showing, as a non-limiting example, one embodiment of this oil injection device and this variable-speed scroll refrigeration compressor.

FIG. 1 shows an oil injection device 2 for a variable-speed scroll refrigeration compressor.

The oil injection device 2 comprises an oil pump 3 designed to be rotationally coupled to the rotor of the electric motor of the compressor. The oil pump 3 is advantageously a positive displacement pump, for example a gear-within-gear positive displacement pump.

Figure 6:
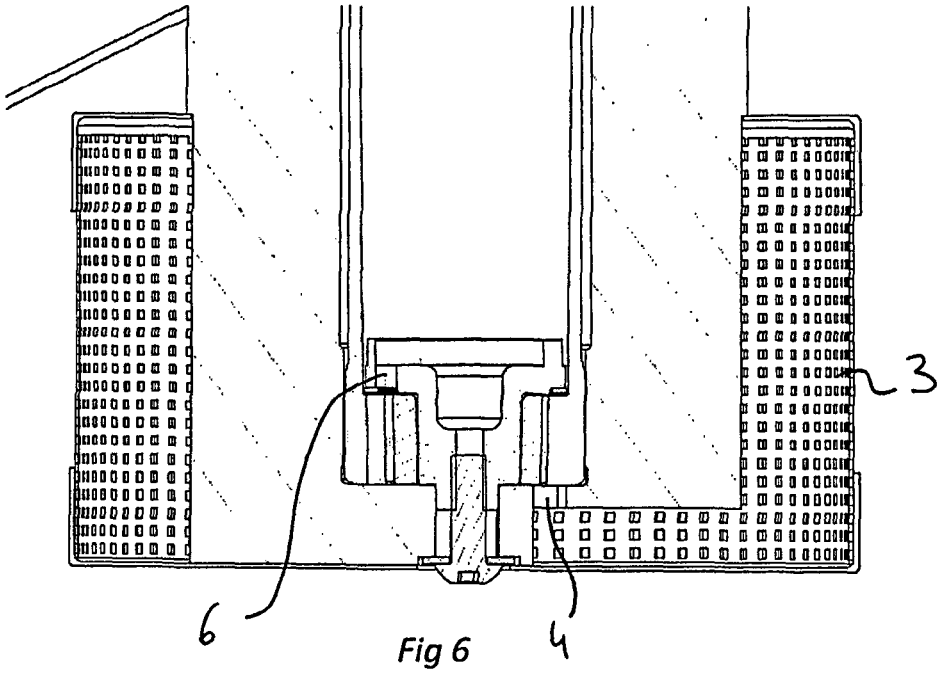
FIG. 6 is an enlarged cross-sectional view of the oil displacement pump of the injection device of FIG. 1.

The oil pump 3 comprises an oil inlet port 4 (see FIG. 6) designed to be connected to an oil sump of the compressor, a first oil outlet port 5, and a second oil outlet port 6.

The oil injection device 2 also comprises a connector 7 designed to be housed in the sealed enclosure of the compressor. The connector 7 has at least one oil inlet port 8 supplied with oil through a supply duct 9 connected to the first oil outlet orifice 5 of the oil pump 3, a first oil outlet orifice 11 connected to an oil injection duct 12 designed to supply a compression stage of the compressor with oil, and a second oil outlet port 13 connected to an oil return duct 14 designed to return the oil into the oil sump of the compressor.

The oil inlet port 8 is connected to the oil outlet ports 11, 13 by a connecting chamber 15 formed in the connector 7.

Advantageously, the oil injection device 2 includes a second oil injection duct 12. According to one embodiment of the invention, the connector 7 has a second oil outlet port 11 emerging in the connecting chamber 15 and connected to the second injection duct 12. According to another embodiment of the invention, the two oil injection ducts 12 are connected to the same outlet port 11 by means of a duct portion.

Each oil injection duct 12 includes an injection tubing 12*a* having a substantially constant transverse section.

The oil injection ducts 12 are configured such that the pressure losses in each oil injection duct 12 are primarily singular pressure losses proportional to the square of the oil flow rate in said oil injection duct 12. In this way, each oil injection duct 12 also comprises a choke member, such as an injection nozzle 16, mounted at the end of the respective injection tubing 12*a* opposite the oil pump 3.

Figure 1:
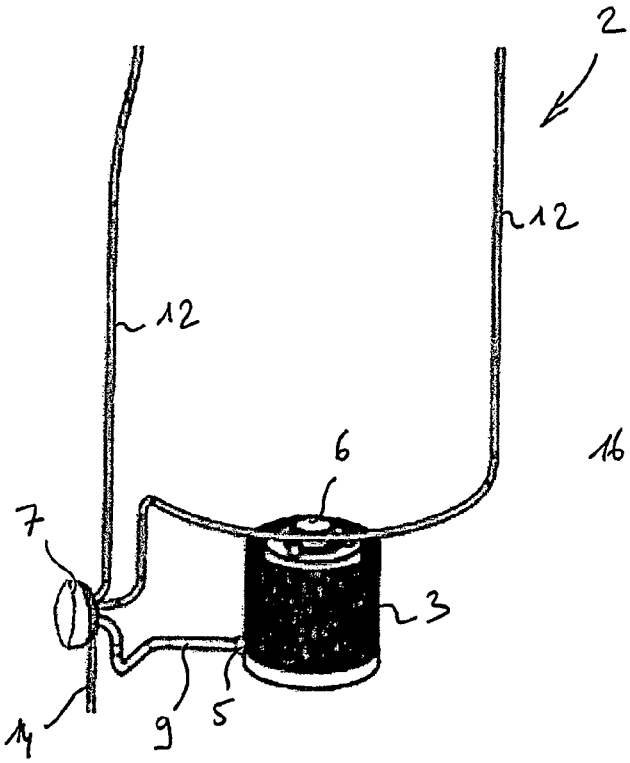
FIG. 1 is a perspective view of an oil injection device according to the invention.
Figure 2:
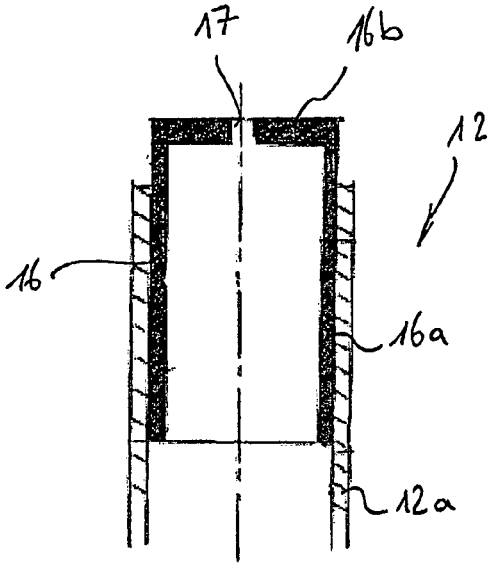
FIG. 2 is a view of an end portion of an oil injection duct of the device of FIG. 1.
Figure 3:
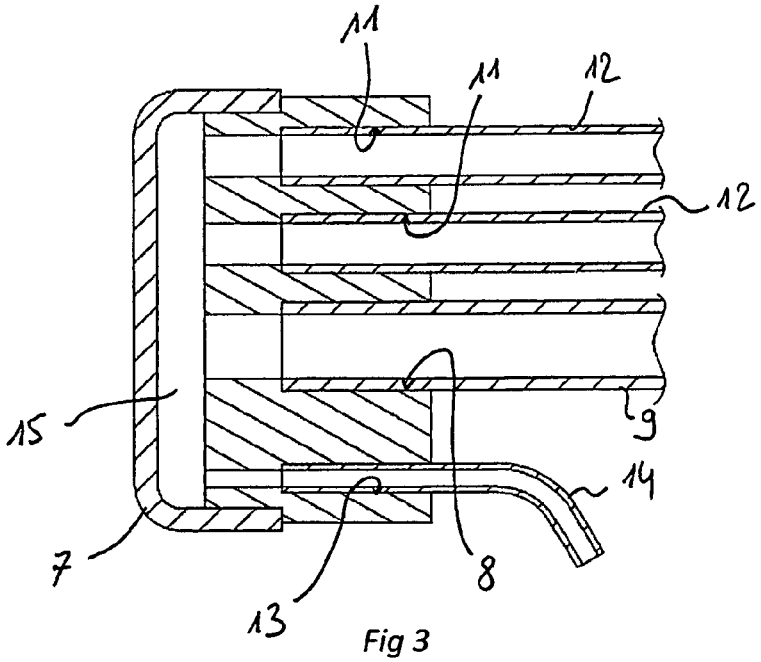
FIG. 3 is a cross-sectional view of a connector of the injection device of FIG. 1.

As shown in FIG. 2, each choke member 16 includes a tubular portion 16*a* having a first open end and a second end closed by an end wall 16*b*. The end wall 16*b* of each choke member 16 includes an injection port 17 having a diameter smaller than half the diameter of the respective oil injection duct 12. The injection port 17 preferably has a diameter equal to approximately one eighth the diameter of the respective oil injection duct 12.

The injection port 17 for example has a diameter of approximately 0.5 mm, while each oil injection duct 12 has a diameter of approximately 4 mm. According to one embodiment of the invention, the tubular portion 16*a* of each choke member 16 has a diameter of approximately 3.8 mm.

Advantageously, the oil return duct 14 is formed by a tubing having a substantially constant transverse section. The oil return duct 14 is configured such that the pressure losses in the oil return duct 14 are primarily pressure losses due to friction proportional to the oil flow rate in the oil return duct 14.

Figure 9:
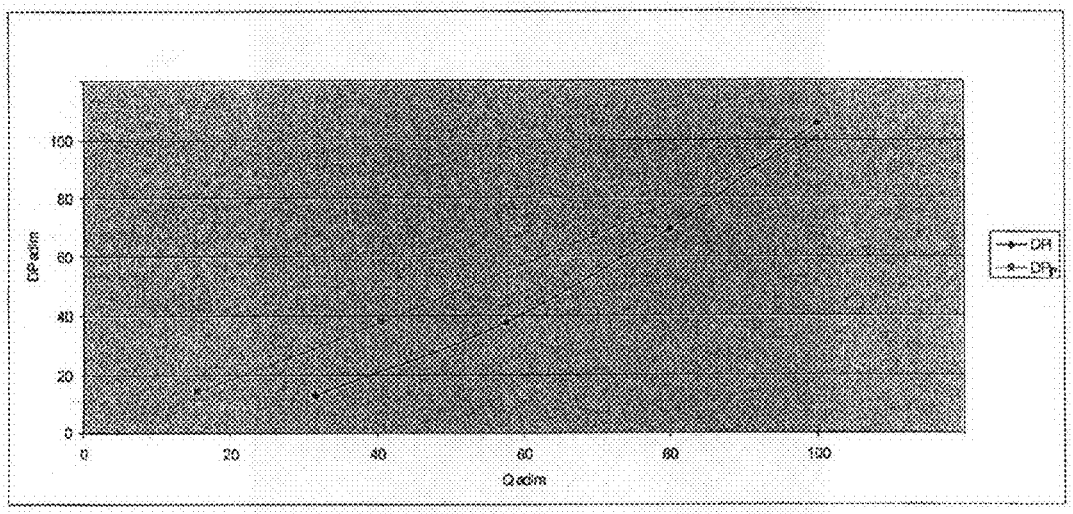
FIG. 9 is a graph showing the evolution of the pressure losses in the oil injection and oil return ducts of the injection device as a function of the flow rate respectively passing through the oil injection and oil return ducts.

FIG. 9 shows the evolution of the pressure losses DPI in the oil injection ducts 12 and the pressure losses DPr in the oil return duct 14 as a function of the flow rate respectively passing through the oil injection 12 and oil return 14 ducts. It should be noted that the different flow rate and pressure loss values shown in FIG. 9 are dimensionless and represent percentages. The flow rate values have been made dimensionless by using the maximum value of the flow rate passing through the respective duct as the reference value (100%), while the pressure loss values have been made dimensionless by using the value of the pressure losses in the return duct 14 as the reference value (100%). In FIG. 9, it is clearly shown that the pressure losses in the oil return duct vary linearly with the flow rate passing through the oil return duct, unlike the pressure losses in the oil injection duct, which evolve exponentially with the flow rate passing through the oil injection duct.

Figure 10:
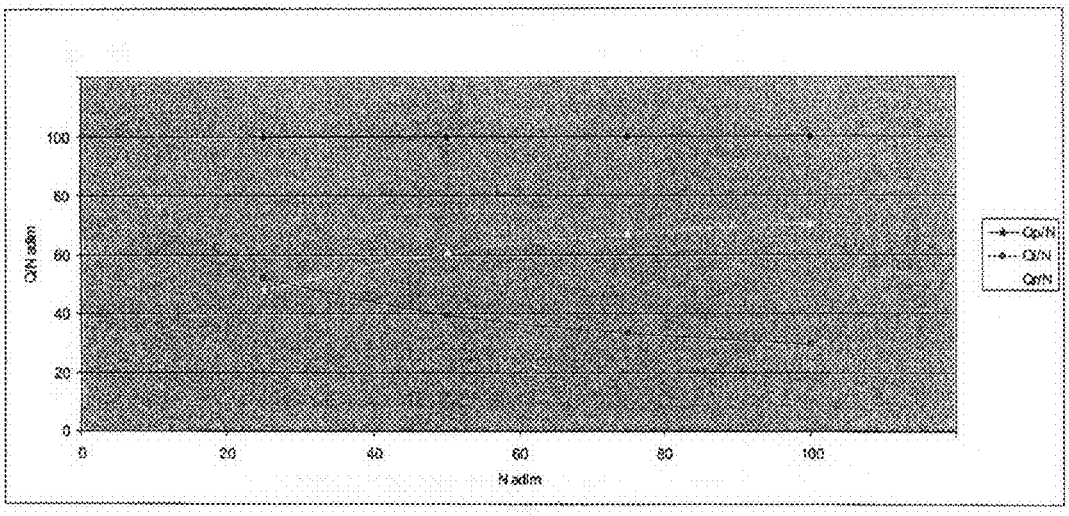
FIG. 10 is a graph showing the evolution of the flow rate of the oil pump exiting through the first oil outlet port thereof, and the flow rates of the oil injection and oil return ducts as a function of the speed of rotation of the oil pump.

As more particularly shown in FIG. 10, the positive displacement pump 3 is configured such that the ratio of the volume flow rate Qp exiting through the first oil outlet port 5 of the pump to the speed of rotation N of the pump is substantially constant irrespective of the speed of rotation of the pump. FIG. 10 also shows the ratio of the volume flow rate Qi of the oil injection ducts 12 to the speed of rotation N of the pump and the ratio of volume flow rate Qr of the oil return duct 14 to the speed of rotation N of the pump as a function of the speed of rotation N of the pump. It must be noted that the different speed of rotation and ratio values shown in FIG. 10 are dimensionless and represent percentages. The speed of rotation values have been made dimensionless using the maximum speed of rotation value as the reference value (100%), while the ratio values have been made dimensionless by using the value of the ratio Qp to N as reference value (100%).

Figure 8:
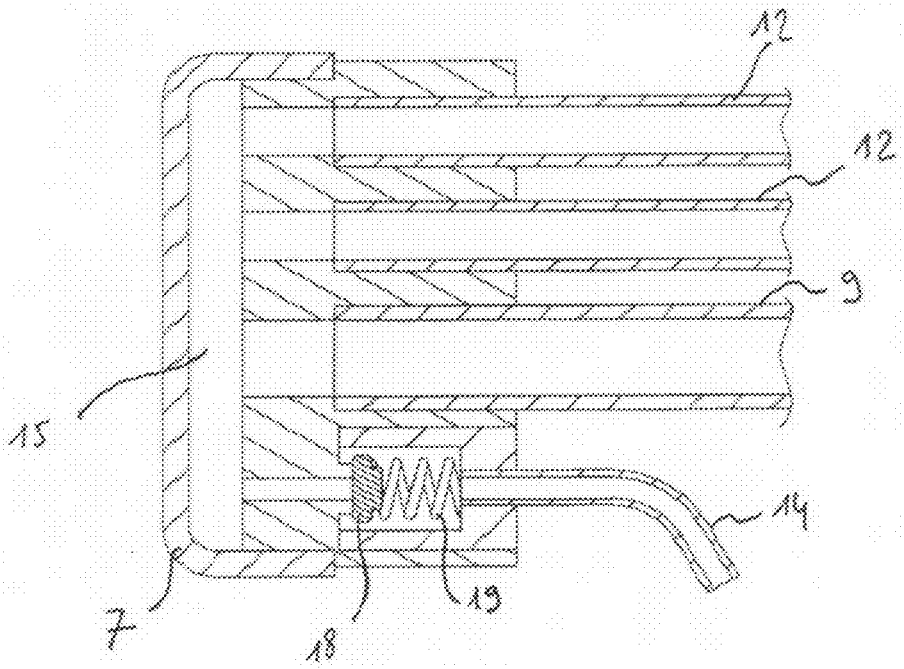
FIG. 8 is a cross-sectional view of a connector of an injection device according to one alternative embodiment of the invention.

According to one alternative embodiment of the invention shown in FIG. 8, the oil injection device 2 has a closure member 18, such as a stopper valve, movable between an open position, allowing oil to flow in the oil return duct 14, and a closed position, preventing oil from flowing in the oil return duct 14, and return means arranged to bias the closure member 18 toward its closed position. Preferably, the return means include a spring 19, the stiffness of which is adjusted so as to allow the closure member 18 to move toward its open position when the pressure difference on either side of the closure member 18 is above the taring threshold of the spring, and to allow the closure member 18 to move toward its closed position when the pressure difference on either side of the closure member 18 is below the taring threshold of the spring. The closure member 18 may for example be mounted in the connector 7.

According to one embodiment of the invention, the second oil outlet port 6 of the oil pump 3 is designed to be connected to a lubrication duct formed in the central portion of the drive shaft rotationally coupled to the electric motor of the compressor.

Figure 4:
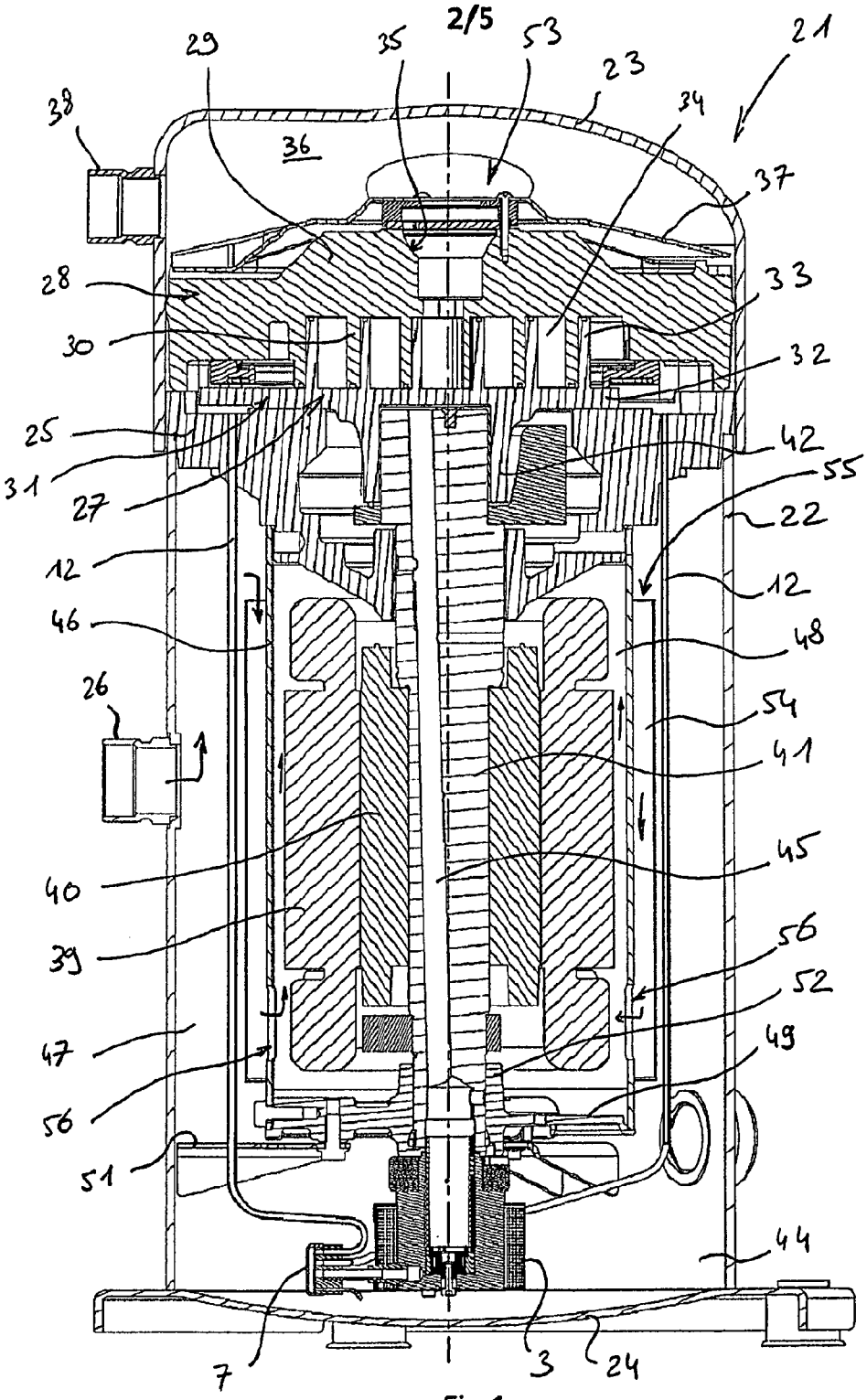
FIG. 4 is a longitudinal cross-sectional view of a variable-speed scroll refrigeration compressor equipped with an injection device of FIG. 1.
Figure 5:
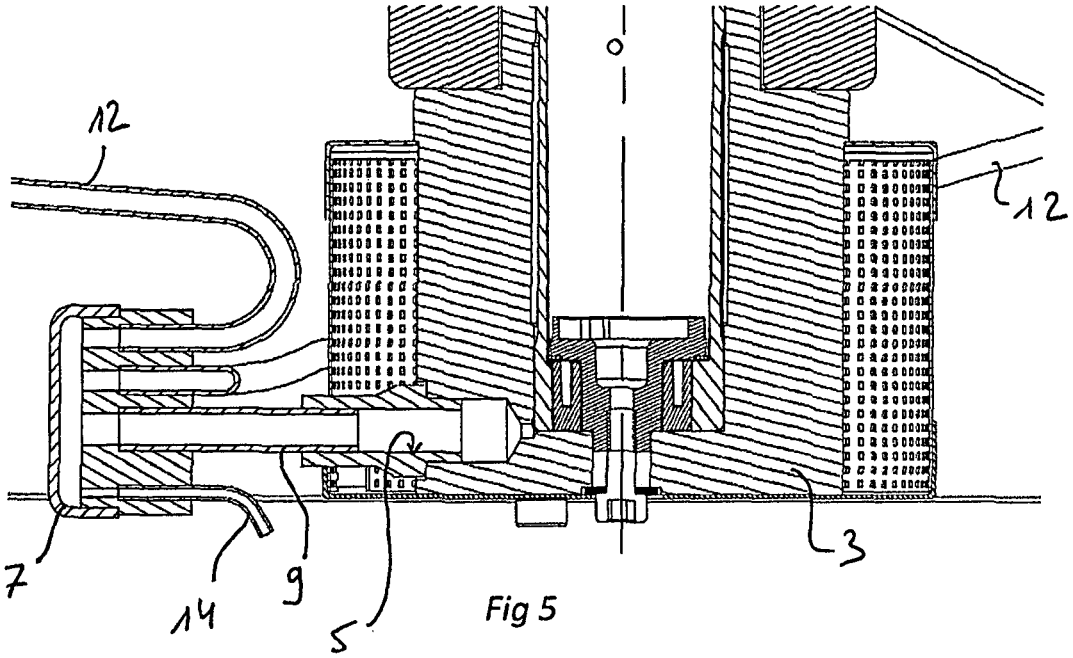
FIG. 5 is an enlarged view of a detail of FIG. 4.

FIG. 4 shows a variable-speed scroll refrigeration compressor 21 comprising an oil injection device 2 according to the invention.

The compressor shown in FIG. 4 comprises a sealed enclosure delimited by a shroud 22, the upper and lower ends of which are respectively closed by a cover 23 and a base 24. This enclosure may in particular be assembled using weld seams.

The intermediate portion of the compressor 21 is taken up by a body 25 that delimits two volumes, a suction volume situated below the body 25, and a compression volume arranged above said body. The shroud 22 comprises a refrigerant inlet 26 emerging in the suction volume to bring refrigerant into the compressor.

The body 25 comprises two through bores in each of which the end portion of one of the oil injection ducts 12 is inserted opposite the oil pump 3 of the oil injection device 2.

The body 25 serves to mount a compression stage 27 for the refrigerant. This compression stage 27 comprises a stationary volute 28 having a plate 29 from which a stationary scroll 30 extends turned downward, and a moving volute 31 including a plate 32 bearing against the body 25 and from which a scroll 33 extends turned upward. The two scrolls 30 and 33 of the two volutes penetrate one another to form variable-volume compression chambers 34.

The compressor 21 also comprises a discharge duct 35 formed in the central portion of the stationary volute 28. The discharge duct 35 comprises a first end emerging in a central compression chamber and a second end designed to be put in communication with a high-pressure discharge chamber 36 formed in the enclosure of the compressor. The discharge chamber 36 may potentially be partially delimited by a separating plate 37 mounted on the plate 29 of the stationary volute 28 so as to surround the discharge duct 35.

The compressor 21 also comprises a refrigerant outlet 38 emerging in the discharge chamber 36.

The compressor 21 comprises a three-phase electric motor arranged in the suction volume. The electric motor comprises a stator 39 at the center of which a rotor 40 is arranged. The speed of the electric motor can be varied using a variable-frequency electric generator.

The rotor 40 is secured to a drive shaft 41, the upper end of which is off-centered like a crankshaft. This upper portion is engaged in a sleeve-forming portion 42 of the moving volute 31. When it is rotated by the motor, the drive shaft 41 drives the moving volute 31 in an orbital movement.

The lower end of the drive shaft 41 is arranged to rotate the oil pump 3 of the oil injection device 2 housed in the lower portion of the sealed enclosure. The oil inlet port 4 of the oil pump 3 is connected to an oil sump 44 of the compressor delimited partly by the base 24 and the shroud 22, while the oil outlet port 6 of the oil pump 3 is connected to a lubrication duct 45 formed in the central portion of the drive shaft 41. The lubrication duct 45 is off-centered and preferably extends over the entire length of the drive shaft 41. The oil pump 3 is thus designed to supply the supply duct 9 and the lubrication duct 45 with oil.

The compressor 21 also comprises an intermediate jacket 46 surrounding the stator 39. The end of the intermediate jacket 46 opposite the oil sump 44 is fastened on the body 25 separating the suction and compression volumes, such that the intermediate jacket 46 serves to fasten the electric motor. The intermediate jacket 46 delimits an annular outer volume 47 with the sealed enclosure on the one hand, and an inner volume 48 containing the electric motor on the other hand.

The compressor 21 also comprises a centering piece 49, fastened on the sealed enclosure using a fastening piece 51, provided with a guide bearing 52 arranged to guide the end portion of the drive shaft 41 turned toward the oil sump 44. The end of the intermediate jacket 46 turned toward the oil sump is fastened on the centering piece 49 such that the centering piece 49 substantially closes the entire end of the intermediate jacket 46 turned toward the oil sump 44.

The compressor 21 also comprises a non-return device 53 mounted on the plate 29 of the stationary volute 28 at the second end of the discharge duct 35, and in particular including a discharge valve that can be moved between a closing position, preventing the discharge duct 35 from being put in communication with the discharge chamber 36, and a released position, allowing the discharge duct 35 to be put in contact with the discharge chamber 36. The discharge valve is designed to be moved into its released position when the pressure in the discharge duct 35 exceeds the pressure in the discharge chamber 36 by a first predetermined value substantially corresponding to the adjustment pressure of the discharge valve.

Figure 7:
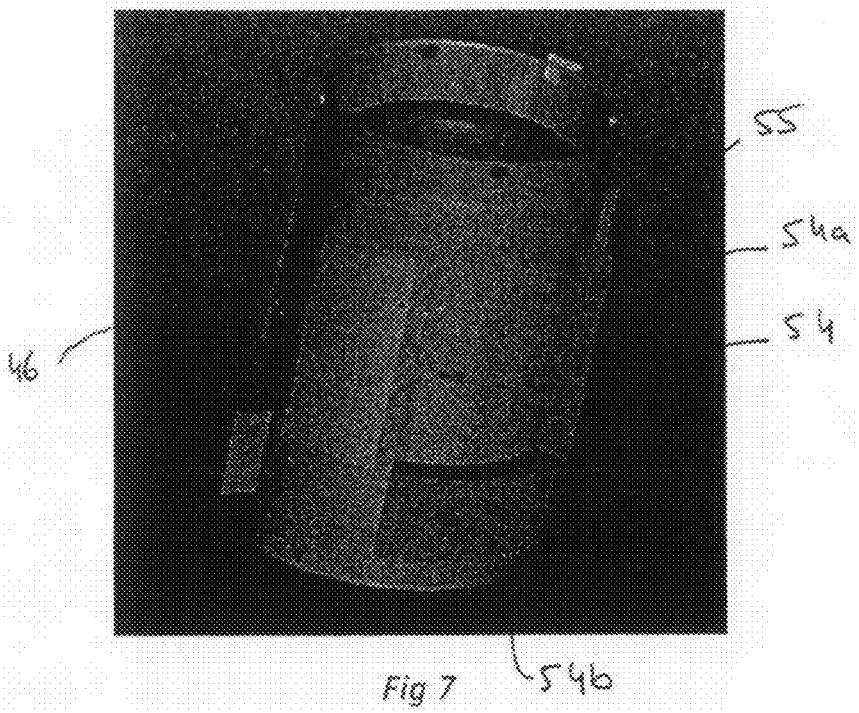
FIG. 7 is a perspective view of the intermediate jacket of the compressor of FIG. 4 showing an oil separating device mounted on the outer wall of the intermediate jacket.

The compressor 21 also includes an oil separating device mounted on the outer wall of the intermediate jacket 46. As shown more particularly in FIG. 7, the oil separating device includes at least one refrigerant circulation channel 54, and possibly two refrigerant circulation channels 54 that are angularly offset. Each fluid circulation channel 54 includes a refrigerant inlet opening 55 emerging in the annular outer volume 47 and a refrigerant outlet opening emerging in the inner volume 48. Each circulation channel 54 includes a first portion 54*a*, turned toward the refrigerant inlet opening 55, extending substantially parallel to the axis of the compressor, and a second portion 54*b*, turned toward the refrigerant outlet opening, extending transversely to the axis of the compressor and preferably substantially perpendicular to the axis of the compressor.

The refrigerant outlet opening of each refrigerant circulation channel 54 for example emerges at a window 56 formed in the intermediate jacket 46 so as to put the refrigerant circulation channel 54 in communication with the inner volume 48 delimited by the intermediate jacket 46.

Advantageously, the refrigerant inlet opening 55 of each refrigerant circulation channel 54 is axially offset relative to the refrigerant inlet 26, and is situated near the end of the electric motor turned toward the compression stage 27.

The compressor 21 is thus configured such that under usage conditions, a flow of refrigerant circulates through the refrigerant inlet 26, the annular outer volume 47, the refrigerant circulation channel 54, the window 56, the inner volume 48, the compression stage 27, the discharge duct 35, the non-return device 53, the discharge chamber 36, and the refrigerant outlet 38.

The operation of the scroll compressor will now be described.

When the scroll compressor according to the invention is turned on, the rotor 40 rotates the drive shaft 41 and the oil pump 3 supplies the supply duct 9 from the oil contained in the sump 44. The oil then penetrates the oil inlet port 8 of the connector 7. As long as the speed of the compressor, and therefore of the oil pump, is low, a significant proportion of the oil having penetrated the connector 7 is oriented toward the first and second oil injection ducts 12 via the connecting chamber 15 and the first outlet ports 11, because the pressure losses are relatively low in each injection duct 12. The oil injected into the first and second injection ducts 12 is then injected into the compression stage 27 by means of injection nozzles 16.

As the speed of the compressor, and therefore the oil pump, increases, the proportion of oil entering the connector 7 through the oil inlet port 8 and oriented toward the oil injection ducts decreases, while the proportion of oil supplying the oil return duct 14 and returned into the oil sump 44 of the compressor increases, due to the fact that the pressure losses in each injection duct 12 increase much more quickly with the flow rate passing through each injection duct 12 than the pressure losses in the oil return duct 14. In this way, at a high speed, the majority of the oil having penetrated the connector 7 falls by gravity into the oil sump 44.

The oil injection device 2 according to the invention makes it possible to increase the quantity of oil present in the compression stage 27 of the compressor, and therefore to increase the level of oil in the refrigerant only when the speed of the compressor is low. The present invention thus makes it possible to improve the low-speed performance of the variable-speed compressor without harming the efficiency thereof at high speeds.

The invention is of course not limited solely to the embodiment of this oil injection device described above as an example; on the contrary, it encompasses all alternative embodiments.

The invention claimed is:

1. An oil injection device for a variable-speed scroll refrigeration compressor, the oil injection device comprising:

an oil displacement pump designed to be rotationally coupled to a rotor of an electric motor of the compressor, the oil displacement pump comprising an oil inlet port designed to be connected to an oil sump of the compressor and a first oil outlet port;

at least one oil injection duct connected to the first oil outlet port of the oil displacement pump and designed to supply a compression stage of the compressor with oil;

an oil return duct connected to the first oil outlet port of the oil displacement pump and designed to return oil into the oil sump of the compressor; and a connector configured to be positioned inside a sealed enclosure of the compressor, the connector having (1) at least oil inlet port supplied with oil through a supply duct connected to the first outlet port of the oil displacement pump, (2) a first oil outlet port connected to the oil injection duct, and (3) a second oil outlet port connected to the oil return duct, wherein the oil injection duct and the oil return duct are configured such that (i) pressure losses in the oil injection duct are primarily singular pressure losses proportional to a square of an oil flow rate passing through the oil injection duct, and such that pressure losses in the oil return duct are primarily pressure losses due to friction proportional to an oil flow rate passing through the oil return duct, (ii) the pressure losses in the oil injection duct are lower than the pressure losses in the oil return duct when a speed of rotation of the oil displacement pump is lower than a first predetermined value, and (iii) the pressure losses in the oil injection duct are greater than the pressure losses in the oil return duct when the speed of rotation of the oil displacement pump is above a second predetermined value, the second predetermined value being greater than or equal to the first predetermined value, and wherein the oil injection device is configured to monitor injection of oil in the compression stage without a solenoid valve.

2. The oil injection device according to claim 1, wherein the oil displacement pump is configured such that a ratio of a volume flow rate of the oil displacement pump exiting through the first oil outlet port to the speed of rotation of the oil displacement pump is substantially constant irrespective of the speed of rotation of the oil displacement pump.

3. The oil injection device according to claim 1, wherein the oil injection duct comprises a choke member mounted at an end of the oil injection duct opposite the oil displacement pump.

4. The oil injection device according to claim 3, wherein the choke member has an injection port having a diameter smaller than half of a diameter of the end of the oil injection duct opposite the oil displacement pump.

5. The oil injection device according to claim 3, wherein the choke member has a tubular portion having a first open end and a second end at least partially closed by an end wall, the end wall including an injection port.

6. The injection device according to claim 1, including a closure member movable between an open position, allowing oil to flow into the oil return duct, and a closed position, preventing oil from flowing in the oil return duct, and a return means arranged to bias the closure member toward the closed position.

7. The oil injection device according to claim 6, wherein the return means is arranged to keep the closure member in the closed position as long as the speed of rotation of the oil displacement pump is below a predetermined value, and to allow the closure member to move toward the open position once the speed of rotation of the oil displacement pump reaches said predetermined value.

8. The oil injection device according to claim 1, wherein the oil return duct has a constant transverse section.

9. The oil injection device according to claim 1, wherein the oil injection duct includes an injection tubing having a constant transverse section.

10. The oil injection device according to claim 1, wherein a ratio of a length of the oil injection duct to a diameter of the oil injection duct is greater than a ratio of a length of the oil return duct to a diameter of the oil return duct.

11. The oil injection device according to claim 1, wherein the oil displacement pump comprises a second oil outlet port designed to be connected to a lubrication duct formed in a central portion of a drive shaft rotationally coupled to the electric motor of the compressor.

12. The oil injection device according to claim 1, including a connector having at least one oil inlet port supplied with oil through a supply duct connected to the first outlet port of the oil displacement pump, a first oil outlet port connected to the oil injection duct, and a second oil outlet port connected to the oil return duct.

13. The oil injection device according to claim 1, wherein the oil return duct has a length longer than at least ten times a diameter of the oil return duct.

14. A variable-speed scroll refrigeration compressor, comprising:

a sealed enclosure containing a compression stage, an oil sump housed in a lower portion of the sealed enclosure, an electric motor having a stator and a rotor, and the oil injection device according to claim 1, wherein the oil displacement pump of the oil injection device is rotationally coupled to the rotor of the electric motor.

15. The compressor according to claim 14, wherein the sealed enclosure includes a suction volume and a compression volume respectively arranged on either side of a body contained in the sealed enclosure, an end of the oil injection duct opposite the oil displacement pump emerging in the compression volume.

16. The compressor according to claim 15, wherein a portion of the end of the oil injection duct opposite the oil displacement pump is inserted into a through bore formed in the body separating the compression and suction volumes.

17. The compressor according to claim 14, wherein the compressor includes an intermediate jacket surrounding the stator so as to delimit an annular outer volume with the sealed enclosure on the one hand, and an inner volume containing the electric motor on the other hand, and an oil separating device mounted on an outer wall of the intermediate jacket, the separating device having a refrigerant circulation channel including a refrigerant inlet opening emerging in the annular outer volume and a refrigerant outlet opening emerging in the inner volume.

18. An oil injection device for a variable-speed scroll refrigeration compressor, the oil injection device comprising:

an oil displacement pump designed to be rotationally coupled to a rotor of an electric motor of the compressor, the oil displacement pump comprising an oil inlet port designed to be connected to an oil sump of the compressor and a first oil outlet port;

at least one oil injection duct connected to the first oil outlet port of the oil displacement pump and designed to supply a compression stage of the compressor with oil;

an oil return pipe connected to the first oil outlet port of the oil displacement pump and designed to return oil into the oil sump of the compressor; and a connector configured to be positioned inside a sealed enclosure of the compressor, the connector having (1) at least oil inlet port supplied with oil through a supply duct connected to the first outlet port of the oil displacement pump, (2) a first oil outlet port connected to the oil injection duct, and (3) a second oil outlet port connected to the oil return pipe, wherein the oil injection duct and the oil return pipe are configured such that (i) pressure losses in the oil injection duct are primarily singular pressure losses proportional to a square of an oil flow rate passing through the oil injection duct, and such that pressure losses in the oil return pipe are primarily pressure losses due to friction proportional to the oil flow rate passing through the oil return pipe, (ii) the pressure losses in the oil injection duct are lower than the pressure losses in the oil return pipe when a speed of rotation of the oil displacement pump is lower than a first predetermined value, and (iii) the pressure losses in the oil injection duct are greater than the pressure losses in the oil return pipe when the speed of rotation of the oil displacement pump is above a second predetermined value, the second predetermined value being greater than or equal to the first predetermined value, and wherein the oil injection device is configured to monitor injection of oil in the compression stage without a solenoid valve.

19. An oil injection device for a variable-speed scroll refrigeration compressor, the oil injection device comprising:

an oil displacement pump designed to be rotationally coupled to a rotor of an electric motor of the compressor, the oil displacement pump comprising an oil inlet port designed to be connected to an oil sump of the compressor and a first oil outlet port;

at least one oil injection duct connected to the first oil outlet port of the oil displacement pump and designed to supply a compression stage of the compressor with oil;

an oil return duct connected to the first oil outlet port of the oil displacement pump and designed to return oil into the oil sump of the compressor; and a connector configured to be positioned inside a sealed enclosure of the compressor, the connector having (1) at least one oil inlet port supplied with oil through a supply duct connected to the first outlet port of the oil displacement pump, (2) a first oil outlet port connected to the oil injection duct, and (3) a second oil outlet port connected to the oil return duct, wherein the oil injection duct and the oil return duct are configured such that (i) pressure losses in the oil injection duct are primarily singular pressure losses proportional to a square of an oil flow rate passing through the oil injection duct, and such that pressure losses in the oil return duct are primarily pressure losses due to friction proportional to an oil flow rate passing through the oil return duct, (ii) the pressure losses in the oil injection duct are lower than the pressure losses in the oil return duct when a speed of rotation of the oil displacement pump is lower than a first predetermined value, and (iii) the pressure losses in the oil injection duct are greater than the pressure losses in the oil return duct when the speed of rotation of the oil displacement pump is above a second predetermined value, the second predetermined value being greater than or equal to the first predetermined value, and wherein the oil return duct has a length longer than at least ten times a diameter of the oil return duct.

* * * * *